US006915801B2

(12) United States Patent
Pokras

(10) Patent No.: US 6,915,801 B2
(45) Date of Patent: Jul. 12, 2005

(54) COMBINATION OXYGEN SUPPLEMENT AND SWIMMING SNORKEL APPARATUS

(76) Inventor: Norman Pokras, 19431 Ironwood La., Huntington Beach, CA (US) 92648

( * ) Notice: Subject to any disclaimer, the term of this patent is extended or adjusted under 35 U.S.C. 154(b) by 27 days.

(21) Appl. No.: 10/612,574

(22) Filed: Jul. 2, 2003

(65) Prior Publication Data

US 2005/0000515 A1 Jan. 6, 2005

(51) Int. Cl.[7] ..... B63C 11/02

(52) U.S. Cl. ..... 128/201.27; 128/201.11; 128/204.26

(58) Field of Search ..... 128/201.11, 201.27, 128/201.28, 204.26, 205.21, 205.22

(56) References Cited

U.S. PATENT DOCUMENTS

| | | | | | |
|---|---|---|---|---|---|
| 407,527 | A | * | 7/1889 | Hilchen | 128/201.23 |
| 1,324,514 | A | * | 12/1919 | Muller | 128/201.11 |
| 2,317,237 | A | * | 4/1943 | Wilen | 128/201.11 |
| 2,488,261 | A | * | 11/1949 | Bedini | 128/201.11 |
| 2,671,445 | A | * | 3/1954 | Charbonnel | 128/201.12 |
| 2,844,145 | A | * | 7/1958 | Berge | 128/205.22 |
| 2,906,262 | A | * | 9/1959 | Braunstein | 128/202.14 |
| 3,018,776 | A | * | 1/1962 | Saitta et al. | 128/206.17 |
| 3,051,170 | A | * | 8/1962 | Benzel | 128/201.11 |
| 3,224,444 | A | * | 12/1965 | Dempster | 128/204.26 |
| 3,292,618 | A | * | 12/1966 | Davis et al. | 128/201.19 |
| 3,433,222 | A | * | 3/1969 | Pinto | 128/201.24 |
| 3,603,306 | A | * | 9/1971 | Bonin, Jr. | 128/201.11 |
| 3,762,407 | A | * | 10/1973 | Shonerd | 128/201.23 |
| 4,022,201 | A | * | 5/1977 | Diggs | 128/201.11 |
| 4,304,229 | A | * | 12/1981 | Curtin | 128/201.11 |
| 4,878,491 | A | * | 11/1989 | McGilvray, III | 128/201.11 |
| 4,938,211 | A | * | 7/1990 | Takahashi et al. | 128/204.26 |
| 5,101,818 | A | * | 4/1992 | Chace et al. | 128/201.14 |
| 5,438,977 | A | * | 8/1995 | Gomez et al. | 128/202.14 |
| 5,524,611 | A | * | 6/1996 | Fu | 128/201.11 |
| 6,073,626 | A | * | 6/2000 | Riffe | 128/201.11 |

FOREIGN PATENT DOCUMENTS

| | | | |
|---|---|---|---|
| DE | 189504 | * | 5/1956 |
| FR | 2484357 | | 12/1981 |
| IT | 584071 | | 10/1958 |

* cited by examiner

*Primary Examiner*—Aaron J. Lewis
(74) *Attorney, Agent, or Firm*—Fulwider Patton Lee & Utecht, LLP

(57) ABSTRACT

A swimming snorkel and oxygen supplement apparatus that includes a mask and a headband strap to which is mounted a snorkel device, including a snorkel tube and a mouthpiece for inspiration of atmospheric air therethrough, and an oxygen supply system for communicating supplemental oxygen to the snorkel device.

19 Claims, 2 Drawing Sheets

COMBINATION OXYGEN SUPPLEMENT AND SWIMMING SNORKEL APPARATUS

BACKGROUND OF THE INVENTION

1. Field of the Invention

The present invention relates to devices for breathing air from above the water during swimming and snorkeling activities, and more particularly, to a snorkel apparatus that permits such breathing while also providing a supplemental source of oxygen for inspiration by the user.

2. Description of Related Art

In human beings, oxygen is the fuel that helps our bodies create energy. As we breath in air, our lungs transfer oxygen to the billions of red blood cells that circulate in our blood stream. These red blood cells then transfer the oxygen to distant organs and cells throughout the body. When there is a shortage of oxygen in the red blood cells, less oxygen reaches these organs and cells, which places extra demands on the body. Additionally, oxygen is critical for muscle functioning. Proper oxygenation of the blood allows the body to produce and supply adenosine triphosphate (commonly known as "ATP") to the muscles, giving them strength and elasticity. A lack of oxygen causes the body to produce ATP less efficiently and generate lactic acid, which, when it builds up in the muscles, reduces the efficiency of muscle contractions and can lead to cramps, pulls, and strains.

While at the beginning of the twentieth century the atmospheric oxygen concentration was notably higher, it is now generally accepted that the atmospheric air we breathe contains approximately only 20 percent oxygen. Therefore, it is believed by many that it has become more important for one's well-being to supplement oxygen content in the body, and that it is also advantageous to supplement oxygen intake while exercising. For example, in order to fuel and rejuvenate their bodies, for many years athletes have inspired supplemental oxygen during brief respites in their training and competition, and drink manufacturers have even begun to market oxygenated water to supplement the body's oxygen levels. Also, an increasing segment of the population has begun to frequent oxygen bars, where they inspire supplemental oxygen with the belief that it may result in benefits such as reducing stress, increasing energy and alertness, lessening the effects of headaches and sinus problems, and generally relaxing the body.

For the average person, however, visits to oxygen bars or the frequent purchase of oxygenated water may be cost prohibitive. Many such persons nevertheless participate in a regular fitness program with the goal of increasing stamina and well-being, and such programs can include a variety of aerobic activities suited to the individual needs and physiology of the person.

It is well recognized that swimming and snorkeling are challenging and beneficial aerobic activities, which provide a healthy alternative to high impact forms of cardiovascular exercise such as running. When engaging in such activities, snorkeling devices permit a swimmer to breath the air from the ambient above water atmosphere while swimming under it, and many recreational swimmers will wear such devices even while swimming laps or the like as part of their exercise regimen. Such snorkeling devices have taken a variety of forms in the prior art, and generally incorporate a mask and a mouthpiece connected to an air tube that is configured to extend above the user's head and through which he or she may breath air from above the water. While such devices have proven suitable for most swimming and snorkeling applications, the swimmer does not receive the above referenced benefits derived from the simultaneous inspiration of a supplemental supply of oxygen during exercise.

For deeper water swimming and diving, and for remaining under water for sustained time periods, many different underwater breathing devices have also been proposed. Such devices will generally include a supply of compressed air that is delivered by way of a conduit to a mouthpiece, from which the diver will breath in the delivered air. Some of these types of devices, such as disclosed in U.S. Pat. No. 3,051,170 to Benzel and U.S. Pat. No. 2,488,261 to Bedini, are adapted to permit the diver to breath air from either an air storage tank or from the above water atmosphere by way of a snorkel tube. In such devices, a valve located in the distal portion of the snorkel tube permits air to pass into the tube when it is above water, but will close off when submerged to prevent the entrance of water. The user then relies upon the inspiration of air from the air storage tank until the distal end of the snorkel tube again emerges into the air and the valve opens back up, at which point the user will resume breathing atmospheric air through the snorkel tube. However, the air storage tank of such devices is cumbersome and not suitable for exercise applications such as swimming laps and the like. Moreover, such devices are not constructed to permit the swimmer to breathe air from the atmosphere while simultaneously inspiring supplemental oxygen from a supplemental source and deriving the benefits therefrom.

Therefore, a need exists for a snorkeling device that affords a swimmer the air intake capability of traditional snorkeling devices, while also providing a supplemental source of oxygen so that the swimmer may, at the same time, derive the well-being benefits believed to be associated with supplemental oxygen inspiration. It would be especially beneficial if such a device were adapted for use during the swimming of laps or other such aerobic exercises performed in the water. The present invention fulfills this need.

SUMMARY OF THE INVENTION

Briefly and in general terms, the present invention is directed to a swimming snorkel apparatus that includes a snorkel device, through which the user inspires air from the above water atmosphere, and a supplemental oxygen supply system in communication with the snorkel device for simultaneously providing supplemental oxygen to the swimming user.

More particularly, the snorkel apparatus includes a mask or goggles formed with a headband strap for mounting the apparatus to the swimmer's head and to which the snorkel device may be connected by a snorkel connector. In one preferred embodiment, the snorkel device includes a snorkel tube in communication with a mouthpiece that engages with the swimmer's mouth for breathing therethrough.

The supplemental oxygen supply system includes an oxygen canister that may be releasably strapped to the headband strap and connected to the oxygen supply. In a preferred embodiment, the canister or housing is releasably joined, in a water tight connection, with a flow valve that is configured to initiate the flow of oxygen from the canister when it is connected to the valve. The flow valve may also be constructed to operate in conjunction with an associated flow control by which the user may regulate and control the flow rate of oxygen from the canister through the flow valve. An oxygen supply tube, extending from the flow valve and in communication with the snorkel tube, then facilitates the flow of oxygen from the valve and through the snorkel tube for inspiration by the user. It is also contemplated that, in an alternate embodiment, the oxygen supply tube may be connected to the mouthpiece for the flow of oxygen directly therethrough to the mouth of the user. Through the oxygen supply tube, supplemental oxygen is thereby introduced into the snorkel device to be inspired by the user along with the inhalation of air from the above water atmosphere. Thus, while the user will rely on the snorkel tube for breathing, air intake will be augmented by the inspiration of oxygen, and the user's well-being will be enhanced by both the exercise of swimming and the simultaneous and supplemental inspiration of oxygen.

These and other features and advantages of the swimming snorkel apparatus will become apparent from the following detailed description of preferred embodiments which, taken in conjunction with the accompanying drawings, illustrate by way of example the principles of the invention.

DETAILED DESCRIPTION OF THE PREFERRED EMBODIMENTS

Figure 1:
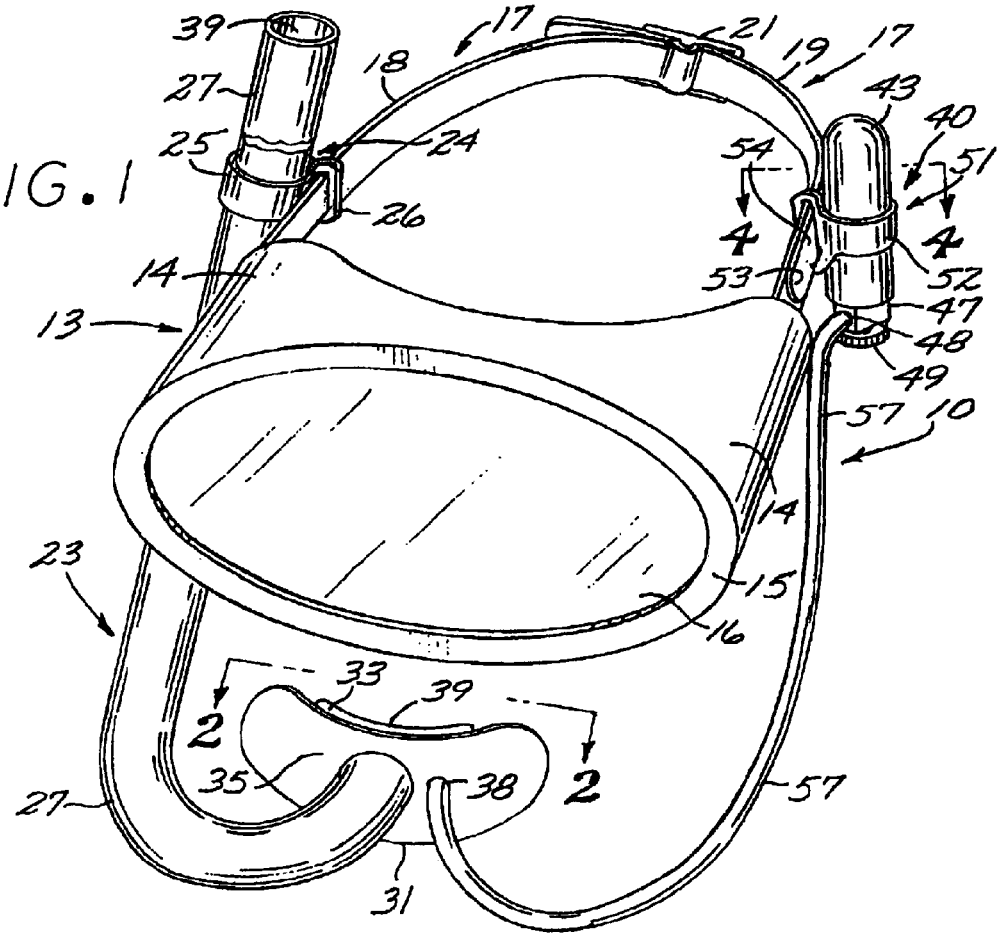
FIG. 1 is a broken perspective view of the swimming snorkel apparatus embodying the present invention.
Figure 5:
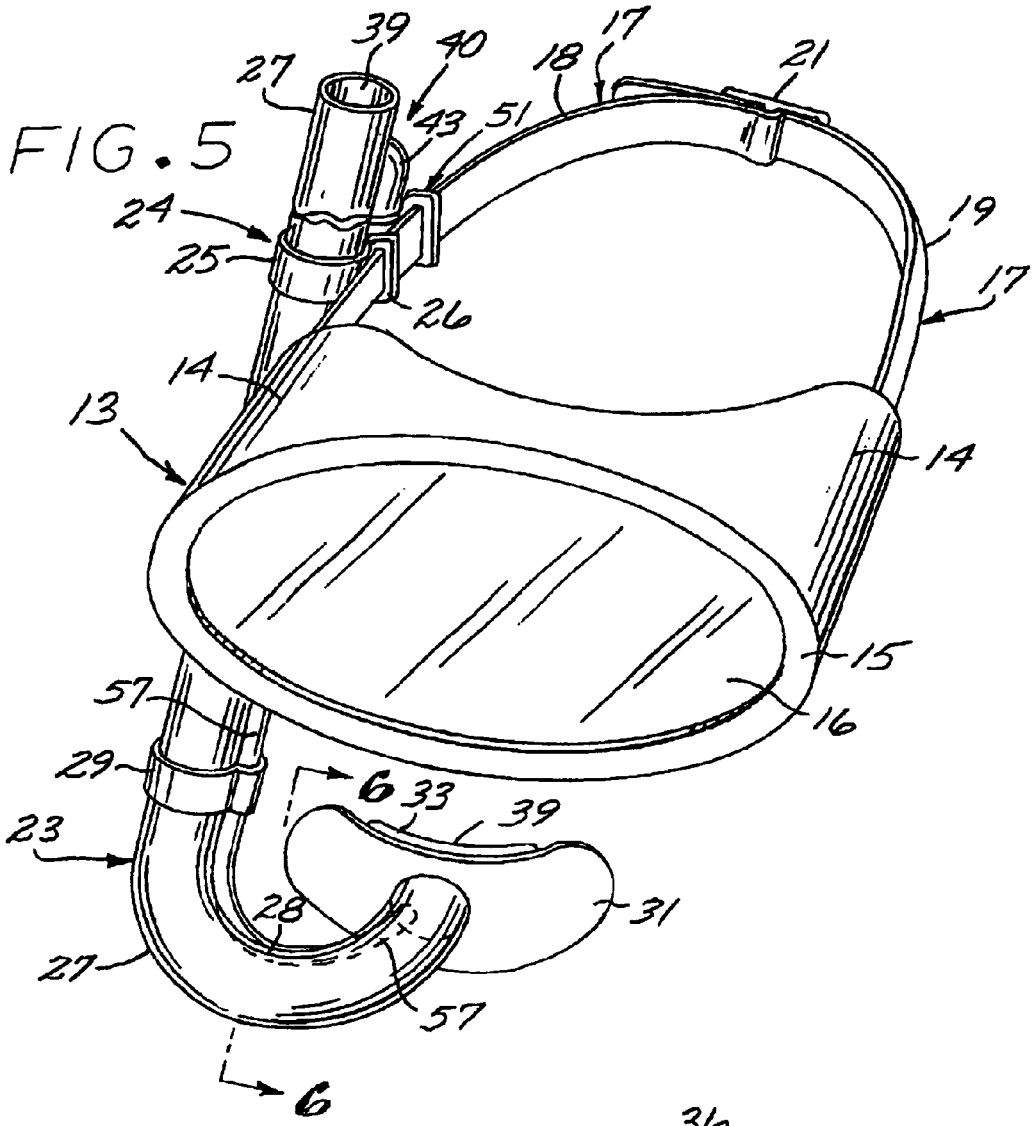
FIG. 5 is a broken perspective view of a second embodiment of the swimming snorkel apparatus of the present invention.

Referring to FIGS. 1 and 5, the oxygen supplement and swimming snorkel apparatus 10 of the present invention includes, generally, a mask 13 having a headband strap 17, a snorkel device 23 that includes a snorkel tube 27 and a mouthpiece 31, and an oxygen supply system 40 including an oxygen canister 43, a flow valve 47 and an oxygen supply tube 57 in communication with the snorkel device 23.

The mask 13 facilitates the underwater vision of the user and may take any variety of forms that are well known in the art. In a preferred embodiment, as shown in FIGS. 1 and 5, the mask 13 includes a skirt 14, which is preferably formed from a rubber or other such material having sufficient elasticity to form a watertight seal with the face of a user when positioned around his or her eye area. The skirt 14 terminates in a lens housing 15 configured for receiving, in a watertight seal, a transparent lens 16. The lens 16 may be constructed of known materials, such as glass or plastic, that will permit the user to see through the lens 16.

For mounting the mask 13, and in general the snorkel apparatus 10, to the head of the user, the skirt 14 is formed, on its side facing away from the lens 16, with a headband strap 17, which may include laterally spaced apart mounting strap segments 18 and 19 that extend rearwardly from the skirt 14. In a preferred embodiment as shown in FIG. 5, one of the segments 18 may be formed on its distal extremity with an attachment and adjustment bracket 21 for releasably receiving the distal extremity of the other segment 19 therethrough and securing the headband strap 17 to the head of the user. The user may adjust the headband strap 17 around his or her head by advancing or withdrawing the distal end of strap 19 through the adjustment bracket 21. However, it is also contemplated that skirt 14 may be formed with attachment lugs or any other suitable devices for receiving either a continuous or segmented headband strap, and that such a strap may be connectable around the head of the user and adjustable by any suitable means known in the art.

As shown in the preferred embodiment of FIG. 5, the snorkel device 23, which permits the user to breath atmospheric air from above the water, includes a mouthpiece 31 and a snorkel tube 27 attached to the headband strap 17 by a snorkel connector 24. The preferred snorkel tube 27 is "J"-shaped, and terminates on its shorter curved end at mouthpiece 31, which is received in the mouth of the user and is in communication with snorkel tube 27. The snorkel device 25 is attached to the headband strap 17 by a snorkel connector 24 that may be located at any comfortable position along the length of the strap 17 or its segments 18 and 19. While the particular form of this connector 24 is not essential to the functioning of the invention, in a preferred embodiment as shown in FIGS. 1 and 5, it will include a retaining ring 25, through which the snorkel tube 27 is passed, which forms a friction fit with the tube 27 to retain it in place. A "C"-shaped bracket 26, dimensioned for receiving the strap 17 in its opening, is attached to the ring 25 so that the strap 17 may be received through the "C"-shaped bracket 26, thereby attaching the snorkel device 25 to the strap 17. It is also contemplated, however, that the snorkel connector 24 may take on any appropriate form so long as it functions to releasably attach the snorkel tube 27 to the head band strap 17 or one of its segments 18 and 19.

Figure 2:
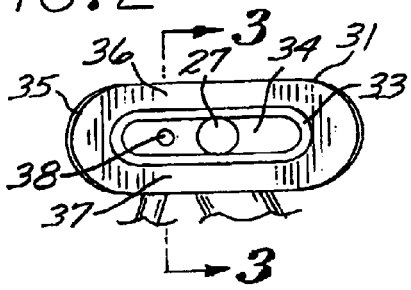
FIG. 2 is a back view taken from line 2—2 of FIG. 1.
Figure 3:
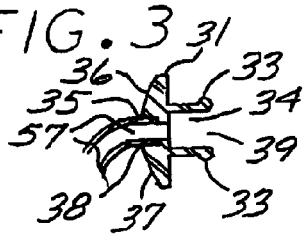
FIG. 3 is a transverse sectional view taken along line 3—3 of FIG. 2.
Figure 7:
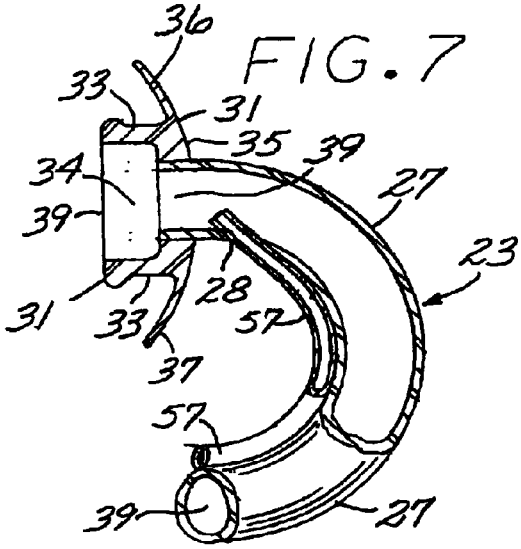
FIG. 7 is a sectional view taken along line 7—7 of FIG. 6.

With reference now to FIGS. 2, 3 and 7, the mouthpiece 31 is formed with a hollowed bit 33 to be retained between the upper and lower teeth of the user, and an arcuate retaining hood 35 including an upper and a lower flange, 36 and 37. The hollowed portion of the bit 33 defines an air passage 34 that is in communication with both the snorkel tube 27 and the mouth of the user, thereby defining an inspiration path 39 between the snorkel tube 27, the mouthpiece 31 and the mouth of the user. While the passage 34 and bit 33 are shown in FIG. 2 to be generally oval or racetrack shaped in transverse cross-section, they may take on any suitable shape to facilitate an ergonomic interaction with the mouth of the user. With the bit 33 secured between the teeth of the user, the upper flange 36 curves upwardly and inwardly and the lower flange curves downwardly and inwardly from respective forward lateral edges of the bit to respectively cover the upper and lower lips of the user. This construction assists in forming a seal around the mouth of the user to deter water from entering the mouthpiece 31 and to prevent the mouthpiece from being pushed into the user's mouth. While one particular embodiment has been shown and described, the mouthpiece 31 may be formed of any appropriate material, such as rubber or a suitable molded plastic, and may also take on any of the numerous potential configurations known in the art. Thus, with the mouthpiece 31 secured in the mouth of the user and in communication with the snorkel tube 27, the user may breath in air along inspiration path 39 and then exhale foul air either through his or her nose or back through the mouthpiece 31 and snorkel tube 27 to be released into the above water atmosphere.

Turning now to the oxygen supply system 40, as shown in FIG. 1 it generally includes an oxygen canister 43 for storing and supplying oxygen, an oxygen supply connector 44 for attaching the oxygen canister 43 to the head band strap 17, and an oxygen supply tube 57 for communicating the oxygen from the canister to the snorkel device 23. Through this oxygen supply system 40, the user will be provided with a flow of oxygen to supplement the atmospheric air inspired through snorkel tube 27 and to provide the additional health benefits derived from the inspiration of oxygen during the swimming and snorkeling exercise session.

The oxygen canister 43 may be either replaceable or refillable, and may be either selected from commercially available canisters or specifically manufactured for the present invention. The canister 43 is small enough in size and volume to be attached to the headband strap 17 and comfortably carried on the head of the user during a swimming and snorkeling exercise session. It is contemplated, however, that its volume will nevertheless be filled with pressurized oxygen sufficient to provide a continuous flow, at a controlled rate, for at least 15 to 20 minutes. The contours of canister 43 may take on a plurality of shapes, which will all include at least a neck (not shown) that is complementally received in a flow valve 47 (see FIG. 1) and through which oxygen will flow, under pressure, out of the canister. To derive the maximum benefits from the invention, it is contemplated that the canister 43 will be filled with pure oxygen, however, various diluted concentrations of oxygen may also be selected for filling the canister.

While the manner in which the flow of oxygen is initiated from the canister is not essential to the invention, it is contemplated that the oxygen canister 43, whether purchased as a replacement or refilled and resealed after discharge, will include a neck seal (not shown) to prevent the flow of oxygen from the resting canister. This neck seal may take on any suitable form such as, for example, a puncturable membrane, a piercable cap or a movable plug. To initiate and facilitate the flow of oxygen from the canister 43 when its neck is received in the flow valve 47, the flow valve may include an appropriate means for penetrating the neck seal and creating a passage through which the air will flow from the canister 43. This means may include, for example, a pointed projection extending upwardly from the base of the flow valve 47 that is configured to penetrate the neck seal when the canister neck is fully received in the flow valve 47.

It is also contemplated, to protect the canister 43 and further facilitate the discharge of oxygen therefrom, that the canister may be received in a canister housing (not shown) which will circumscribe the canister and be complementally received in the flow valve 47. The housing may be constructed of any suitable water resistant and durable material, and may be releasably connectable, in a water tight seal, with the flow valve 47. In one preferred embodiment, for example, this connection may be formed with thread segments on the housing that are received in threading formed in the flow valve 47 such that, with the housing screwed into the flow valve and the canister 43 received in the housing, the neck seal of the canister will be breached and the flow of oxygen from the canister will be initiated. It is also contemplated that, in embodiments that do not incorporate a canister housing, the neck of the canister 43 itself may be formed with thread segments to be screwed into complemental threading in the flow valve 47 to releasably secure the canister in the flow valve and initiate the flow of oxygen therethrough.

To regulate and control the flow of oxygen from the canister 43 through the flow valve 47, it is contemplated that the flow valve may be further formed with a flow control device 49. This flow control is shown in FIG. 1 to be in the form of a circular dial that may be rotated accordingly to initiate or terminate and to increase or decrease the rate of oxygen flow through the flow valve 47. However, the flow control 49 may take on any form, it only being important that it be operable to control when the oxygen flows through the valve from the canister and when it does not. The oxygen in the canister 43 is pressurized to maintain its flow through the valve 47 during the swimming and snorkeling exercise session, however, in embodiments including a flow control, the swimmer may manipulate the flow control 49 to continue or terminate this flow, or to increase or decrease its rate.

The oxygen canister 43, or housing with the canister received therein, is connected to the headband strap 17 at any desired location therealong by an oxygen supply connector 51. While the particular form of this connector is not essential to the invention, however, it is contemplated that, in one preferred embodiment as shown in FIG. 5, the oxygen supply connector 51 may take the form of a retaining ring 25 and "C"-shaped bracket 26 connector similar to that of the snorkel connector 24. In such an embodiment, the retaining ring circumscribes the oxygen supply canister 43 or housing, in a friction fit relationship, to secure the oxygen supply to the head band strap 17 with the strap passing through the "C"-shaped bracket 26.

Figure 4:
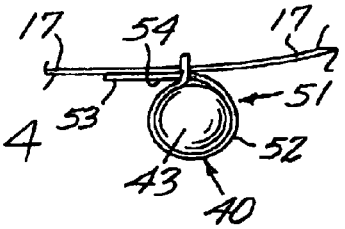
FIG. 4 is a horizontal sectional view taken along line 4—4 of FIG. 1.

However, it is also contemplated that the oxygen supply connector 51 may take on any appropriate form to securely attach the oxygen supply to the head band strap 17. For example, in the alternate embodiment depicted in FIGS. 1 and 4, the connector 51 may be defined by a mounting strap 52 having a cross-tab 53 on one end and a transverse slit 54 on the opposite end. The transverse slit 54 is constructed to complementally receive the headband strap 17, or one of its mounting segment 19, therein. As shown in FIG. 4, the mounting strap 52 is configured to wrap back on itself to encircle and embrace the circumference of the oxygen canister 24 or housing with cross-tab 53 projecting back through transverse slit 54. With both the cross-tab 53 and headband strap 17 projecting through transverse slit 54, the cross-tab 53 will frictionally engage headband strap 17 to hold and lock the oxygen supply in place and mounted to the headband strap 17.

Figure 6:
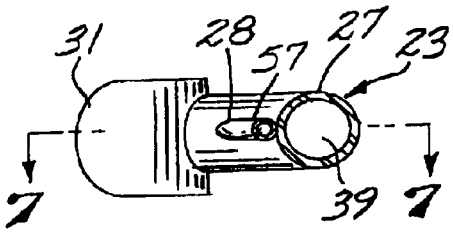
FIG. 6 is a sectional perspective view taken along line 6—6 of FIG. 5.

For communicating the supplemental oxygen from the canister 43 to the user for inspiration, as shown in FIG. 1, an oxygen supply tube 53 is retained, in a water tight seal, in flow valve 47 at valve opening 48, from which it extends to establish fluid communication with the snorkel device 23. As shown in a preferred embodiment at FIG. 5, the oxygen supply canister 43 is attached to headband strap 17 with the oxygen supply connector 51 being located in proximity to snorkel connector 24. So configured, as shown in one preferred embodiment depicted in FIGS. 6 and 7, the oxygen supply tube 53 may extend along the outside length of the snorkel tube 27 until it encounters a tube opening 28, which extends from the outer circumference of snorkel tube 27 to its inner circumference at a location in the vicinity of the transition between snorkel tube 27 and mouthpiece 31. The oxygen supply tube 53 passes through tube opening 28 to terminate on the inside of snorkel tube 27 and remain in communication with the air passage 34 of the mouthpiece, thereby causing oxygen to flow along inspiration path 39 into the mouth of the user. It will be appreciated that, in such an embodiment, a water tight seal will be formed between oxygen supply tube 53 and snorkel tube 27 at tube opening 28, and that the oxygen supply tube 53 may be coextensively attached to the outside of any desired portion of snorkel tube 27 by an appropriate means, such as, for example, clamp 29 shown in FIG. 5.

As shown in the alternative embodiment depicted in FIG. 1, the oxygen supply canister 43 may also be mounted to the headband strap 17 such that oxygen supply tube 53 extends from the flow valve 47 directly to the mouthpiece 31. In such an embodiment, as further shown in FIG. 2, the oxygen supply tube 53 passes through an inlet opening 38 formed through the hood 35 of mouthpiece 31 to communicate oxygen directly to air passage 34 for supplemental inspiration by the user along with the atmospheric air inspired through the snorkel tube 27.

In operation, a user will assemble the swimming snorkel apparatus 10 of the present invention by connecting the snorkel device 23 and the oxygen supply system 40 to the headband strap 17, however, it is also contemplated that the snorkel apparatus 10 may be packaged with the snorkel device and oxygen supply system already mounted to headband strap 17, as shown in FIGS. 1 and 5. For example, the user may first chose to mount the snorkel device 23 to the headband strap 17. To do so, the user will pass strap 17, or one of mounting segments 18 and 19, through the "C"-shaped bracket 26 of snorkel connector 24. Then, the end of the snorkel tube 27 opposite from mouthpiece 31 is passed through retaining ring 25 until it is secured by frictional engagement with the retaining ring in a desired position that permits the mouthpiece 31 to be comfortably received in the user's mouth.

The user may then select an appropriate oxygen canister 43, or housing with the container received therein, and attach the oxygen supply system 40 to the apparatus 10 by connecting the oxygen supply connector 44 to headband strap 17. In the preferred embodiment depicted in FIG. 5, wherein the oxygen supply connector 44 is similar to snorkel connector 24, the headband strap 17 is passed through the complementally dimensioned "C"-shaped clamp 26 and the oxygen canister 43 is secured in retaining ring 25. In the alternative embodiment of FIG. 1, the headband strap 17 is passed through transverse slit 54 of mounting strap 52, which is wrapped around the oxygen supply canister 43 or canister housing such that cross tab 53 also passes through transverse slit 54 and frictionally engages headband strap 17. So configured, the user may tighten strap 52 to secure the canister 43 in place by further advancing cross tab 53 through slit 54.

The user will then enable the flow of oxygen under pressure from canister 43 by connecting the canister, or the housing with the canister received therein, into the flow valve 47. This may be accomplished by screwing the thread segments formed on either the canister neck itself or on the housing into the complemental threading formed in the flow valve 47, which will cause the neck seal to be breached and the oxygen to begin flowing from the canister 43 through the flow valve opening 48. After mounting the canister 43 to the valve 47 and initiating the flow of oxygen, the user may then adjust the flow control 49 to terminate further flow until he or she is ready to inspire supplemental oxygen during the exercise session.

To receive supplemental oxygen during a swimming and snorkeling exercise session, the user will then mount the snorkel apparatus 10 by situating the mask 13 over his or her eyes with the skirt 14 comfortably positioned on the face. The user will then pull the headband strap 17 around his or her head and adjust it through the attachment and adjustment buckle 21 to comfortably secure the strap around the head. The mouthpiece 31 is then inserted into the user's mouth with the bit 33 retained between his or her teeth and the upper and lower flanges, 36 and 37, of the hood 35 extending over the respective upper and lower lips of the user.

At a time, either before beginning the swimming and snorkeling activity or during the exercise session, when the user desires to begin supplemental inspiration of oxygen from the canister 43, the user will then adjust the flow control 49 to permit the flow of oxygen through flow valve 47 into oxygen supply tube 57 for communication therethrough to either the snorkel tube 27, as shown in FIG. 5, or the mouthpiece 31, as shown in FIG. 1. In both embodiments, the oxygen is thereby delivered along inspiration path 39 for inspiration therefrom into the mouth of the user. Thus, to breath during swimming and snorkeling, the user will position the end of the snorkel tube 27 opposite from the mouthpiece 31 above the water, and will breath in through the mouthpiece to draw air along inspiration path 39 through the snorkel tube 27, into the air passage 34, and then into his or her mouth and lungs. With oxygen flowing through supply tube 57, the user is also able to simultaneously inspire oxygen during the exercise session to derive the health and well-being benefits attendant thereto. To expel foul air after inspiration, the user will then expire the foul air through his or her nose or through mouthpiece 31 and snorkel tube 27 to be delivered to the above water atmosphere.

During the exercise session, oxygen continuously flows through the oxygen supply tube 57 to be available for inspiration by the user, and the user may adjust the flow control 49, if present, to increase or decrease, or to terminate and initiate the flow rate of the oxygen as desired. While the oxygen capacity of the canister 43 is relatively small as compared to traditional on-board air tanks used in diving activities, it is contemplated that a typical charge of oxygen will flow continuously for at least about 15–20 minutes, but that this duration will be influenced by the chosen flow rate of the user during the exercise session. When the user completes the exercise session, or when he or she desires to cease receiving supplemental oxygen, the user will terminate the flow of oxygen by adjusting the flow control 49 and will remove the snorkel swimming apparatus by pulling the headband strap 17 over his or her head and removing the mask 13. When the user desires to again begin swimming and snorkeling while receiving supplemental oxygen, he or she will then mount the apparatus and repeat the above described actions.

When the charge of oxygen in the canister 43 has been depleted, or when the user wishes to recharge the canister, he or she will disconnect the canister 43, or the housing containing the canister, from the flow valve 47. As in one above described preferred embodiment, the user will do so by rotating the canister 43 or its housing such that the screw segments formed thereon will be rotated out of complemental engagement with the threading in the flow valve 47. The user will then select a new canister 43, or recharge the spent canister, and mount it to the flow valve 47 as described above to initiate the flow of oxygen from the container. The user may then cut off this flow by adjusting the flow control 49, and may thereafter initiate the flow when he or she desires to again begin receiving supplemental oxygen.

While several particular forms of the invention have been illustrated and described, it will also be apparent to those skilled in the art that various modifications can be made without departing from the spirit and scope of the invention. Accordingly, it is not intended that the invention be limited except by the following claims.

What is claimed is:

1. A swimming snorkel apparatus to be worn by a swimmer comprising:

a mask for receipt on the face of the swimmer constructed to permit vision therethrough;

a mounting strap for encircling the head of the swimmer and cooperating with the mask to secure the mask in place on the head;

a snorkel device attached to the mounting strap and including a mouthpiece and a snorkel tube; and an oxygen supply system attached to the mounting strap and including an oxygen containing canister, a canister connector for mounting the canister to the strap, and an oxygen supply tube for communicating supplemental oxygen from the canister to the snorkel device.

2. The swimming snorkel apparatus of claim 1 wherein:

the swimmer inspires atmospheric air through the snorkel device while simultaneously inspiring the supplemental oxygen therethrough.

3. The swimming snorkel apparatus of claim 1 wherein:

the snorkel device further defines an inspiration path that extends along the length of the snorkel tube, through the mouthpiece and to the mouth of the swimmer and along which the user may inspire atmospheric air; and the oxygen supply system provides supplemental oxygen to the snorkel device at a point along the inspiration path for simultaneous inspiration by the swimmer along with the atmospheric air.

4. The swimming snorkel apparatus of claim 1 wherein:

the snorkel tube is further formed with an outer wall, an inner wall and an oxygen inlet opening that extends from the outer wall to the inner wall; and the oxygen supply tube is connected in fluid communication with the inlet opening.

5. The swimming snorkel apparatus of claim 1 wherein:

the mouthpiece is formed with an oxygen inlet opening in communication with the mouth of the swimmer; and the oxygen supply tube is connected in fluid communication with the inlet opening.

6. The swimming snorkel apparatus of claim 1 wherein:

the oxygen supply system further includes a flow control for initiating, terminating and controlling the rate of the flow of oxygen from the canister to the oxygen supply tube.

7. The swimming snorkel apparatus of claim 1 wherein:

the oxygen supply system includes a flow valve that is configured for complemental and releasable receipt of the canister and is in communication with the oxygen supply tube; and the flow of oxygen from the canister and through the flow valve is initiated when the canister is received in the flow valve.

8. The swimming snorkel apparatus of claim 7 wherein:

the flow valve includes a flow control for initiating, terminating and controlling the rate of the flow of oxygen through the flow valve to the oxygen supply tube.

9. The swimming snorkel apparatus of claim 1 wherein:

the oxygen supply system further includes a canister housing configured for receiving the canister therein; and the canister connector mounts the canister housing to the mounting strap.

10. The swimming snorkel apparatus of claim 9 wherein:

the oxygen supply system includes a flow valve that is configured for complemental and releasable receipt of the housing and is in communication with the oxygen supply tube; and the flow of oxygen from the canister and through the flow valve is initiated when the housing is received in the flow valve.

11. The swimming snorkel apparatus of claim 1 wherein:

the canister connector mounts the canister directly to the mounting strap.

12. A swimming snorkel apparatus configured to provide supplemental oxygen to a swimmer comprising:

a mask including a lens and a body for fitting the face of the swimmer;

a headband strap connected to the mask body for mounting the mask to the head of the swimmer;

a snorkel device including an air tube and a mouthpiece through which the swimmer may inspire atmospheric air;

a supplemental oxygen supply bottle mounted to the headband strap; and an oxygen supply tube for communicating supplemental oxygen from the oxygen supply bottle to the snorkel device for simultaneous inspiration therefrom by the swimmer along with the atmospheric air.

13. The swimming snorkeling apparatus of claim 12 further comprising:

a flow valve for initiating the flow of oxygen from the oxygen supply bottle to the snorkel device.

14. A swimming snorkel apparatus for delivering both atmospheric air and supplemental oxygen to a swimmer comprising:

a mask for receipt on the face of the swimmer that includes a flexible mask body and a transparent lens;

a headband strap that works in cooperation with the mask body to mount the mask to the head of the user;

a snorkel device attached to the headband strap and including an air tube and a mouthpiece through which the swimmer may inspire the atmospheric air; and an oxygen supply means attached to the headband strap for communicating supplemental oxygen to the snorkel device to be simultaneously inspired by the swimmer along with the atmospheric air.

15. The swimming snorkel apparatus of claim 14 wherein:

the oxygen supply means further includes a flow control means for initiating, terminating and controlling the rate of the flow of oxygen communicated to the snorkel device.

16. A swimming snorkel apparatus for delivering both atmospheric air and supplemental oxygen to a swimmer comprising:

a mask for receipt on the face of the swimmer that includes a flexible mask body and a transparent lens;

a headband strap that works in cooperation with the mask body to mount the mask to the head of the user;

a snorkel device attached to the headband strap and including an air tube and a mouthpiece through which the swimmer may inspire the atmospheric air;

an oxygen supply canister mounted to the headband strap;

a flow valve configured for complemental and releasable receipt of the oxygen supply canister and including a flow initiating means for initiating the flow of oxygen from the canister when it is received in the flow valve and a flow control means for controlling the rate of flow of the oxygen through the flow valve; and an oxygen supply tube for communicating supplemental oxygen from the flow valve to the snorkel device for inspiration by the swimmer therefrom while also inspiring the atmospheric air.

17. A method for introducing atmospheric air supplemented with oxygen to a swimmer during swimming and snorkeling exercise including:

selecting a mask;

mounting the mask to the head of the swimmer by a headband strap;

selecting a snorkel device including a snorkel tube and a mouthpiece through which the swimmer may breath the atmospheric air;

attaching the snorkel device to the headband strap;

attaching a oxygen canister charged with a supplemental supply of oxygen to the headband strap; and communicating the supplemental supply of oxygen from the canister to the snorkel device from which the swimmer may simultaneously inspire both the atmospheric air and the oxygen.

18. An oxygen supplementing snorkel device for use by a swimmer in surface swimming and comprising:

a mask and head strap for securing to the head of a swimmer;

an ambient air/oxygen mixing device including a snorkel device having a mouthpiece for introducing a breathing stream to the mouth of the swimmer and including an upstanding snorkel tube for drawing ambient air from the surface while the mask is submerged, such mixing device further including a light weight oxygen canister, including a supplementary oxygen supply tube from the canister to the mouthpiece;

a mounting device for mounting the canister to the head strap whereby the swimmer may don the mask placing the headband strap about his/her head and the mouthpiece in fluid communication with his/her mouth to swim along the surface of a body of water with the snorkel tube drawing ambient air from the atmosphere and the supplementary oxygen supply tube flowing oxygen from the oxygen canister to supplement the ambient air from the supplement tube with oxygen from the canister.

19. The device of claim 18 wherein:

the mixing device is constructed to maintain an open passage from the canister to the mouthpiece for unrestricted flow of oxygen irrespective of the orientation of the swimmer.

* * * * *